US005395660A

United States Patent [19]

Ruschak et al.

[11] Patent Number: 5,395,660

[45] Date of Patent: Mar. 7, 1995

[54] EDGE REMOVAL APPARATUS FOR CURTAIN COATING

[75] Inventors: Kenneth J. Ruschak, Rochester; James E. Conroy, Hamlin, both of N.Y.

[73] Assignee: Eastman Kodak Company, Rochester, N.Y.

[21] Appl. No.: 219,809

[22] Filed: Mar. 29, 1994

Related U.S. Application Data

[63] Continuation of Ser. No. 1,485, Jan. 7, 1993, abandoned.

[51] Int. Cl.[6] ..... B05D 1/30

[52] U.S. Cl. ..... 427/420; 118/324; 118/DIG. 4

[58] Field of Search ..... 427/420; 118/DIG. 4, 118/324

[56] References Cited

U.S. PATENT DOCUMENTS

| | | | |
|---|---|---|---|
| 3,345,972 | 10/1967 | Masulis | 118/301 |
| 3,508,947 | 4/1970 | Hughes . | |
| 3,867,901 | 2/1975 | Greiller | 118/301 |
| 4,559,896 | 12/1985 | Bossard et al. | 118/300 |
| 4,647,482 | 3/1987 | Degrauwe et al. | 427/420 |
| 4,830,887 | 5/1989 | Reiter | 427/420 |
| 4,879,968 | 11/1989 | Denz et al. | 118/300 |
| 4,933,215 | 6/1990 | Naruse et al. | 427/420 |

FOREIGN PATENT DOCUMENTS

| | | | |
|---|---|---|---|
| 272844 | 6/1970 | U.S.S.R. . | |
| 90/01179 | 2/1990 | WIPO | 427/420 |

OTHER PUBLICATIONS

Journal of Colloid and Interface Scient, vol. 77, No. 2 Oct. 1980 pp. 583–585.

*Primary Examiner*—Shrive Beck
*Assistant Examiner*—Katherine A. Bareford
*Attorney, Agent, or Firm*—Carl F. Ruoff

[57] ABSTRACT

The present invention is an edge blade (20) attached to an edge guide (12) for removing an edge of a falling curtain (10). The edge of the falling curtain is intercepted by the edge blade (20) and is vacuumed away by a vacuum tube (21) disposed near the edge blade. The present invention provides a uniform coated edge with maximum coating speeds at the edge being equal to maximum speed possible for the coating system far from the edge.

15 Claims, 3 Drawing Sheets

EDGE REMOVAL APPARATUS FOR CURTAIN COATING

This is a continuation of U.S. application Ser. No. 001,485, filed Jan. 7, 1993, now abandoned.

FIELD OF THE INVENTION

The present invention relates to a method and apparatus for coating objects or moving supports, advancing continuously past a coating station, by the curtain coating method. More particularly, it relates to an improved curtain coating method and apparatus for the manufacture of photographic materials such as photographic film and paper.

BACKGROUND OF THE INVENTION

In coating apparatus of the curtain coating type, the moving support is coated by causing a free falling curtain of coating liquid to impinge onto the moving support to form a layer on said support. An apparatus is described and used in U.S. Pat. No. 3,508,947 wherein a multilayer composite of a plurality of distinct layers is formed on a slide hopper and caused to impinge onto an object or moving support to form a coated layer thereon. U.S. Pat. No. 3,508,947 particularly relates to the manufacture of multilayer photographic materials such as photographic film and paper.

In the coating of photographic products it is necessary to constrain the edges of the curtain to eliminate narrowing of the curtain and a reduction in coating width. It is desirable to have the edges of the curtain be internal to the edges of the film or paper base, henceforth this will be referred to as internal edging. Internal edging is preferable to the practice of maintaining a curtain wider than the base and coating over the edges of the base. However, the edge guides are solid surfaces which slow the coating liquids because of drag they produce. This reduction in velocity results in a significant penalty in the maximum coating speed attainable near the edge. The prior art teaches introducing a lubricating layer of water, or another low viscosity liquid, along the edge guide to reduce the drag and increase the velocity of the coating solutions in the curtain. This water layer or low viscosity liquid layer must, however, be removed in order to maintain acceptable coating latitude and quality and to avoid any penalty in speed for drying the edges. In the removal of the lubricating layer the velocity of the coating liquids must not be reduced in the vicinity of the edge if high speed coating is desired. The prior art teaches the use of a vertical slit connected to a vacuum source at the bottom of the edge guide as the means by which the lubricating water is removed. This is described in U.S. Pat. No. 4,830,887 which is incorporated by reference herein. This technique tends to slow down the coating liquids as the lubricating layer is being removed, hence reducing the maximum attainable coating speed at the edge. Also, some lubricating liquid may flow beyond the slit and not be captured.

Therefore, it is desirable to remove the lubricating liquid layer very abruptly giving the coating liquids near the edge guide very little opportunity to slow down. This maximizes the momentum of the coating liquids in the falling curtain and therefore, maximizes the attainable coating speed for the specific layer viscosities and flow rates being used. It is also desirable to ensure complete removal of the lubricating liquid. The present invention describes a method and apparatus in which the lubricating liquid layer is removed completely and very abruptly. This allows the coating speed of the curtain coating process to be maximized.

SUMMARY OF THE INVENTION

The present invention is a method and apparatus by which the lubricating layer of liquid and/or edge of the curtain in a curtain coating operation are removed very abruptly and efficiently. This is achieved by having the lubricating liquid and optionally, an adjacent narrow section of the curtain fall onto a thin solid blade. The lubricating liquid and curtain which impinge on the blade are then vacuumed away. This allows the remaining curtain to coat with little or no reduction in velocity due to the removal of the edge band of the falling curtain. The key element in the invention is the abruptness by which the lubricating layer is removed by the blade/vacuum combination of the present invention.

For a better understanding of the present invention together with other advantages and capabilities thereof, reference is made to the following detailed description and appended claims in connection with the preceding drawings and description of some aspects of the invention.

Detailed Description of the Preferred Embodiment

Figure 1:
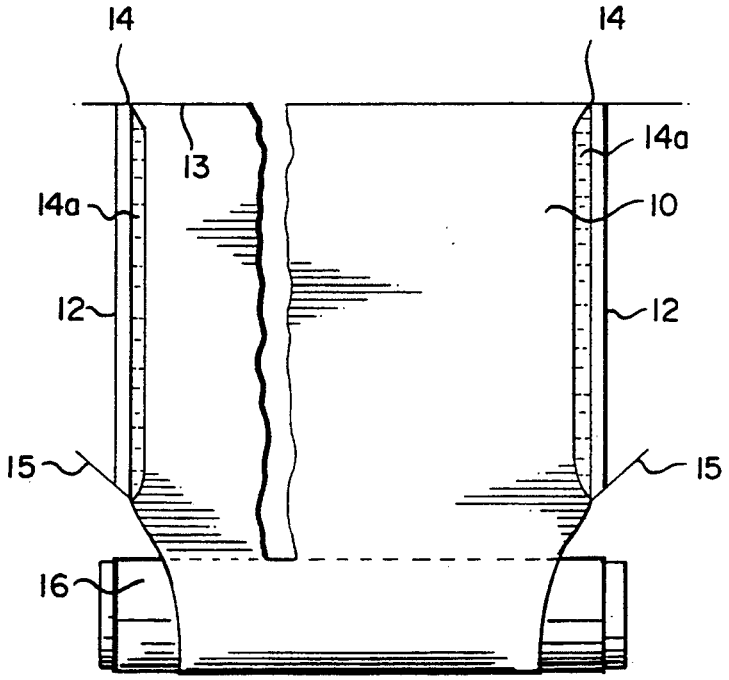
FIG. 1 (PRIOR ART)
FIG. 1 shows a front view of a prior art edge guide and falling curtain.

FIG. 1 illustrates how momentum at the edge of a curtain is lost in a prior art curtain coater when a lubricating liquid is removed. FIG. 1 shows curtain 10 and two prior art edge guides 12 guiding the curtain from the hopper lip 13 to the support 16 to be coated. As the curtain 10 leaves the hopper lip 13 it falls until it impinges upon moving support 16. The curtain is guided at its edges by edge guides 12. The edge guides include a lubricating liquid introduction point 14 for introducing a lubricating liquid layer or band **14*a*** at the edge of the curtain. However, this lubricating band is preferably removed prior to coating the support.

In the prior art as described in U.S. Pat. No. 4,830,387, the lubricating liquid is removed by a vertical vacuum slot in fluid communication with the vacuum inlet 15 which can act to reduce velocity at the edge of the curtain. As the removal of the lubricating layer occurs, the curtain liquids tend to move into closer proximity to the edge guide and hence are affected to a greater degree by drag. This can create nonuniformities at the edges of the support 16 which has been coated by the curtain 10 as the momentum of the coating solutions near the edge are reduced. For example, the curtain can fail to wet the support completely. The edge of the coating may then be ragged and may contain air bubbles. Drops of coating composition can also be created at the point where the edge of the curtain strikes the support. These may create contamination, streaks in the coating, and other process problems.

Therefore, it is desirable to remove the lubricating water layer very abruptly, giving the coating liquids very little time to slow down. This maximizes the momentum of the coating liquids and maximizes the attainable coating speed for the specific layer viscosities and flow rates being used.

Figure 2:
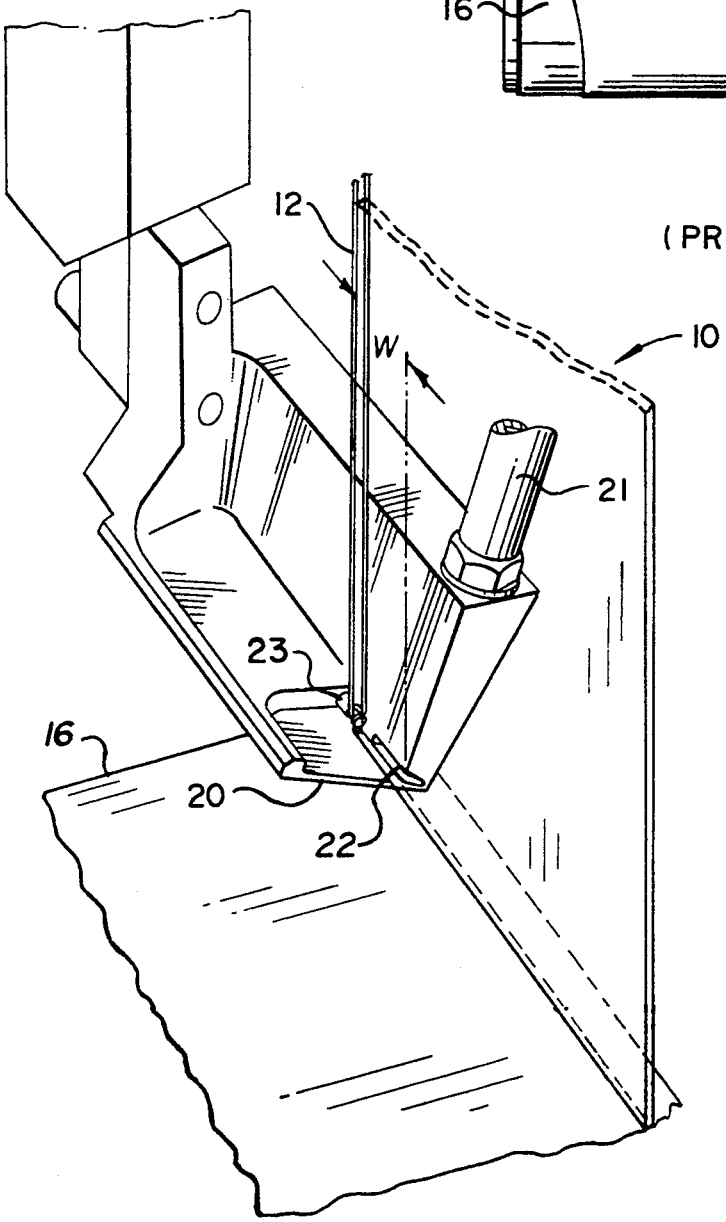
FIG. 2 shows a perspective view of the blade/-vacuum assembly of the present invention.
Figure 3:
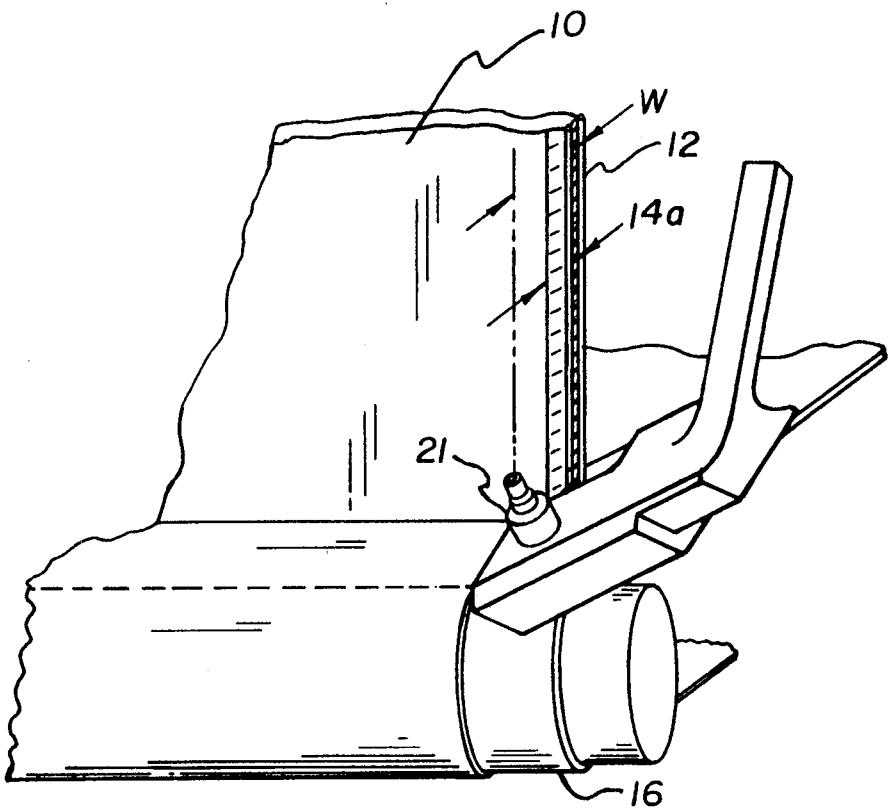
FIG. 3 shows a front perspective view of a curtain and the blade/vacuum assembly of the present invention.

Shown in FIG. 2 is a perspective view of the device of the present invention from behind the curtain 10. FIG. 3 shows a front perspective view of the present invention. FIG. 2 shows a blade 20 attached to the edge guide 12 described in U.S. Pat. No. 5,328,726. Blade 20 extends inward and intercepts the curtain 10. Attached to the blade is a vacuum tube 21 which removes all of the liquids intercepted by the blade 20. The liquids which impinge on the blade are drawn away through the vacuum tube 21 through vacuum slot 22. The liquids which do not contact the blade continue with very little velocity reduction until they impinge on the support 16. The width W of the curtain liquids which impinge on the blade 20 can be varied by adjusting the position of the device with respect to the curtain. The width W is adjusted by the position of pin 23 which positions the edge guide 12, although other methods are possible. A similar pin at the top of the edge guide also has to be adjusted for the edge guide to remain vertical. It is preferable that at least some of the coating liquids be removed to insure that all of the lubricating layer is removed. Edge non-uniformities in the coating liquids originating in the hopper and on the hopper slide can also be removed in this manner. Below blade 20, the free edge of the curtain makes an angle $\alpha$ (not shown) with respect to the vertical.

Figure 4:
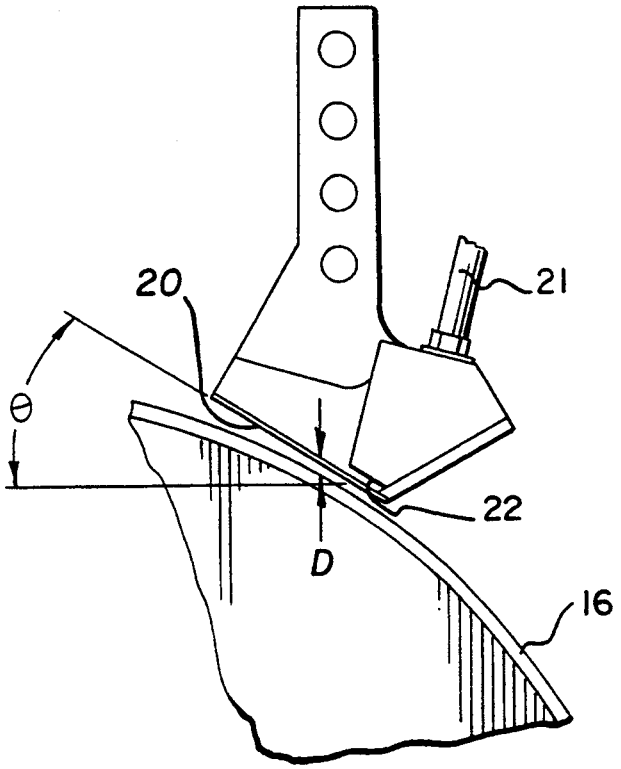
FIG. 4 shows a side view of the blade/vacuum device of the present invention and its position relative to a support.

The angle, $\alpha$, which the free edge of the curtain makes with the vertical is given by the following equation:

$$\sin(\alpha)=(2\gamma/dqv)^{\frac{1}{2}}$$

wherein;

$\alpha$ is the angle;

$\gamma$ is the surface tension of the liquid;

d is the density of the liquid;

q is the volumetric flow rate of the liquid per unit width; and v is the velocity of the liquid (See Journal of Colloid and Interface Science, Vol 77, No. 2, October, 1980, pp 583–585). Therefore, as the gap D (See FIG. 4) between the support 16 and blade 20 is widened the coating width will become narrower, the edge coverage will increase with respect to the middle. This makes it desirable to minimize the gap between the blade and the support. Typical gap values are on the order of one mm. FIG. 4 shows a side view of the vacuum removal device of the present invention. The blade 20 is oriented at an angle $\theta$ sloping downward from back to front. The angle $\theta$ is equal to the slope of the base with respect to the horizontal i.e., the forward application angle, so that the curtain impingement point may be placed as close to the support 16 as desired without interference and is shown in FIG. 4. Preferably, the edge of the blade from which the curtain breaks is parallel to the tangent of the coating roll. Also shown in FIGS. 2 and 4 are the vacuum tube 21 and a vacuum slot 22. The curtain edge liquids intercepted by blade 20, flow into the vacuum slot 22 and are suctioned away through the vacuum tube 21.

It is preferred that the blade 20 of the edge removal device is tilted downwards toward the coating roll, in the direction of the center of the curtain and in the plane of the curtain. This is shown in FIG. 3. In this preferred orientation drips cannot occur from the bottom surface of the blade as the liquid cannot run back beneath the blade. If the blade has no inclination in the plane of the curtain as shown in FIG. 2, or if it is inclined upwards away from the coating roll in the direction of the main body of the curtain and in the plane of the curtain, no vacuum removal means is required, as the edge liquids intercepted by the blade will flow down the blade by gravity, away from the edge of the coating, and can be collected. However, to prevent drips from the bottom surface of the blade, and to minimize excess coating thickness at the edge, a blade tilted toward the coating roll at approximately 30 degrees in the direction of the main body of the curtain and in the plane of the curtain and a suction removal means is preferred.

Figure 5:
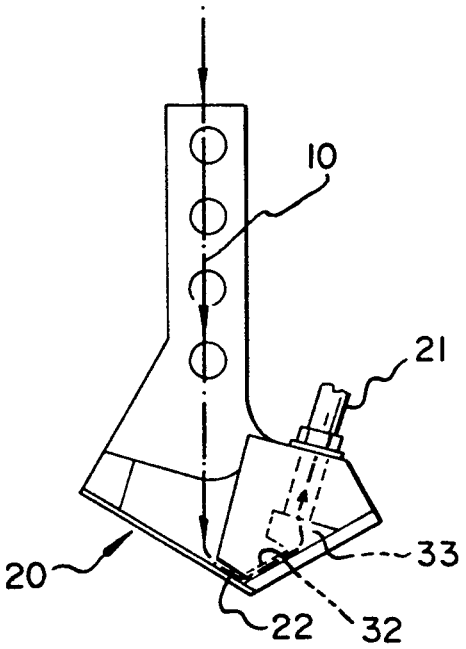
FIG. 5 shows the blade/vacuum device of the present invention and the liquid path in the vacuum body.

FIG. 5 shows the evacuation path of the solutions that contact the blade 20. The curtain 10 falls just behind a vacuum slot 22, i.e. approximately 1 mm from the slot 22, which is open on the two perpendicular faces of the vacuum body. The liquids enter the vacuum body through the vacuum slot 22 and then are channelled through an internal vacuum slot 32, vacuum cavity 33 and vacuum tube 21 which is connected to the vacuum source. The internal vacuum slot 32 and cavity 33 are designed to obtain uniform vacuum potential along the vacuum slot 22.

For strength, the blade is preferably corrosion resistant metal, such as stainless steel or titanium alloy. In the example the blade and vacuum body were made of titanium. The blade is preferably thin to help minimize the distance between the top surface of the blade and the support at the blade's edge (the point of curtain breakoff), and to minimize drag on the edge of the curtain formed at the blade's edge. Metal blades 0.1–0.25 mm thick perform well and have adequate mechanical integrity. The top surface of the blade is preferably smooth enough that flow of liquids is not impeded. The bottom surface of the blade is preferably polished to minimize wetting of the bottom surface. However, blade finish is not crucial to operation of the invention. The working edge of the blade is machined square, no attempt is made to sharpen the blade for safety reasons.

The width and height of the vacuum slot are chosen, along with vacuum level and capacity to insure that all of the intercepted edge band is removed. Preferably, the width of the vacuum slot is comparable to the width of the intercepted edge band. The slot width can be as small as 50% of the curtain removal width. As the slot width becomes much greater than the curtain width a higher vacuum level is required to handle the extra volume of air drawn into the slot which extends outboard of the curtain edge. A slot height of about 0.5 mm has been found to provide sufficiently uniform vacuum potential around the slot without unduly high resistance to flow.

The advantage of this invention when compared to prior art edge guides is that it is possible to coat a very straight edge with better thickness uniformity near the edge than was possible with the prior art. It is also possible to coat products at higher speeds while incurring less waste due to the curtain edging apparatus of the present invention.

EXAMPLE

A single layer application of 50 centipoise aqueous gelatin solution with surfactant and 1.65 cc/cm/sec total flow rate was curtain coated. The application angle $\theta$ used was +30 degrees and the support coated was gelatin-subbed polyethylene terephthalate. The speed was gradually increased until wetting failure occurred at the edge. Two different edge guide configurations were used: a slotted tube (prior art); and an edge guide with a blade removing 4 mm of curtain solutions and all the lubricating liquid, which was water.

For the prior art edge guide the maximum attainable speed was 480 cm/sec. At this point the edge entered wetting failure and the speed could no longer be increased. For the edge guide with blade/vacuum assembly removing 4 mm of curtain solutions and all the lubricating liquid the maximum attainable speed was 660 cm/sec. At this point the edge entered wetting failure. The maximum attainable coating speed for this curtain sufficiently far from the edge as to be unaffected by the edge guide was 700 cm/sec.

Therefore, the invention provided a 37.5% increase in maximum coating speed attainable in the center of the curtain. An increase in coating speed in manufacturing of this magnitude would greatly improve efficiency of the operation and increase the capacity of the plant.

While there has been shown and described what are at present considered the preferred embodiments of the invention, it will be obvious to those skilled in the art that various changes, alterations and modifications may be made therein without departing from the scope of the invention as defined by the appended claims.

What is claimed is:

1. A method of curtain coating a support with at least one layer of a liquid coating composition comprising:

moving the support along a path through coating zone;

forming one or more layers of coating liquids to form a composite layer;

forming a free falling curtain from said composite layer within said coating zone which extends transversely of said path and impinges on said moving support;

laterally guiding said falling curtain by edge guides arranged so that the curtain coats less than the width of said support;

maintaining said falling curtain in wetting contact with said edge guides by distributing flushing liquid from said edge guides contiguous with said falling curtain;

removing liquids from the edge of said falling curtain by providing a blade extending from the edge guide into the falling curtain to intercept a part of the free falling curtain and positioning the blade above the impingement of the falling curtain on the support wherein the blade is angled into the free falling curtain so that the blade is closest to the support where the part of the free falling curtain is intercepted and farthest from the support at the edge guide; and removing by suction the liquids of the free falling curtain intercepted by the blade.

2. An apparatus for curtain coating a support by depositing one or more coating liquids onto a moving support comprising:

conveying means including a coating roll for moving said support having a width along a path through a coating zone;

hopper means for forming one or more flowing layers of coating liquids to form a free falling curtain which extends transversely of said path and impinges on said moving support;

edge guide means spaced a distance apart to produce a coating less than the width of said support for laterally guiding said falling curtain;

flushing means for issuing liquid from said edge guide to maintain wetting contact with said falling curtain; and liquid removal means for extracting liquid from an edge region of said falling curtain, the liquid removal means comprising:

a blade having an upper surface extending into the free falling curtain to intercept a part of the free falling curtain, said blade not contacting said support;

a slot aligned and adjacent the upper surface of said blade spaced from the interception of the part of the free falling curtain by said blade and extending inside an edge of the blade wherein said slot has a width which approximates or is greater than a width of the part of the curtain intercepted; and suctions means for providing a vacuum to said slot wherein the part of the free falling curtain intercepted by said blade is suctioned through said slot such that drag on the free falling curtain is minimized.

3. The apparatus according to claim 2 wherein the blade extending into the free falling curtain is adjustable such that the part of the curtain intercepted is variable.

4. The apparatus according to claim 2 wherein an edge of the liquid removal means is positioned approximately 1 mm from said support.

5. The apparatus according to claim 2 wherein said blade has an upper end and a lower end with a blade edge extending from the upper end to the lower end and in the direction of the moving support.

6. The apparatus according to claim 5 wherein the blade edge forms an angle $\theta$ with the horizontal as one moves along the edge from the lower end to the upper end.

7. The apparatus according to claim 6 wherein the angle $\theta$ is equal to the application angle of the curtain on the coating roll as measured from top of the coating roll in the direction of rotation.

8. The apparatus according to claim 5 wherein the part of the free falling curtain intercepted by said blade flows down a front side of the blade from the upper end to the lower end wherein the part of the free falling curtain intercepted is removed by said suction means.

9. The apparatus according to claim 2 wherein said blade is angled into the free falling curtain so that the blade is closest to the support where the curtain is intercepted and farthest from the support at the edge guide.

10. The apparatus according to claim 2 wherein said slot is spaced approximately 1 mm from the interception of the part of the free falling curtain by said blade.

11. The apparatus according to claim 2 wherein the slot has a height of approximately 0.5 mm.

12. A liquid removal means for extracting liquid from an edge region of a free falling liquid curtain attachable to an edge guide comprising:

a blade having an upper surface and extending from an edge of the free falling curtain to intercept a part of the free falling curtain said blade not contacting a support; and a slot aligned and adjacent the upper surface of said blade spaced from the interception of the part of the free falling curtain by said blade and extending inside an edge of said blade wherein said slot has a width which approximates or is greater than a width of the part of the curtain intercepted; and suction means for providing a vacuum to said slot wherein the part of the free falling curtain intercepted by said blade is suctioned through said slot such that drag on the free falling curtain is minimized.

13. The apparatus according to claim 12 wherein the blade extending into the free falling curtain is adjustable such that the part of the curtain intercepted is variable.

14. The apparatus according to claim 12 wherein said blade is angled into the free falling curtain so that said blade is closest to the support where the curtain is intercepted and farthest from the support at the edge guide.

15. The apparatus according to claim 14 wherein the blade is angled approximately 30° from horizontal.

* * * * *